US006425376B1

(12) United States Patent
Ruehle et al.

(10) Patent No.: US 6,425,376 B1
(45) Date of Patent: Jul. 30, 2002

(54) FUEL INJECTOR

(75) Inventors: Wolfgang Ruehle, Ditzingen; Hubert Stier, Asperg; Matthias Boee, Ludwigsburg; Guenther Hohl, Stuttgart; Norbert Keim, Loechgau, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/602,447

(22) Filed: Jun. 23, 2000

(30) Foreign Application Priority Data

Jun. 24, 1999 (DE) ..... 199 28 916

(51) Int. Cl.[7] ..... F02M 37/04
(52) U.S. Cl. ..... 123/498; 239/533.11
(58) Field of Search ..... 123/498, 490, 123/499; 239/533.11, 533.8, 533.9; 251/214

(56) References Cited

U.S. PATENT DOCUMENTS 4,750,675 A * 6/1988 Sczomak ..... 239/453
5,031,841 A * 7/1991 Schafer ..... 239/585
5,255,855 A * 10/1993 Maier et al. ..... 239/585.4
5,630,550 A * 5/1997 Kurishige et al. ..... 239/533.8
6,189,816 B1 * 2/2001 Stier ..... 239/533.2
6,213,414 B1 * 4/2001 Stier et al. ..... 239/584

* cited by examiner

*Primary Examiner*—Willis R. Wolfe
*Assistant Examiner*—Mahmoud Gimie
(74) *Attorney, Agent, or Firm*—Kenyon & Kenyon

(57) ABSTRACT

A fuel injector, especially an injector for fuel-injection systems of internal combustion engines, includes a piezoelectric or magnetostrictive actuator arranged in an actuator space of a valve housing of the fuel injector, the actuator space being sealed from a fuel by a seal. A valve-closure member, which can be actuated by the actuator and interacts with a valve seat to form a sealed seat, assumes the actual valve operation. The seal has a sealing member and a sealing element. The sealing element is joined to the sealing member by a first circumferential welded seam, is elastically deformable and band-shaped, and is joined to the valve housing by a second circumferential welded seam.

7 Claims, 1 Drawing Sheet

FUEL INJECTOR

FIELD OF THE INVENTION

The present invention concerns fuel injectors.

BACKGROUND INFORMATION

German Published Patent Application No. 40 05 455 concerns fuel injectors purporting to have an actuator arranged in an actuator space, and a valve closure member, which can be actuated by the actuator, via a valve needle, and which interacts with a valve seat to form a sealed seat. Apparently, the actuator space is sealed from a combustion chamber by a spring diaphragm fastened to the valve needle. The spring diaphragm is fixed in the valve housing in a circular recess between two housing halves (sections), which are joined to each other by a welded seam.

It is believed that a disadvantage of the foregoing fuel injector of German Published Patent Application No. 40 05 455 is that the elastic spring diaphragm may be deformed by the fuel pressure in the combustion chamber, which is high in comparison with the pressure in the actuator space. In particular, relatively large sheer forces may be applied to the area where the spring diaphragm is fastened to the valve needle, and to the area where the spring diaphragm is fastened to the valve housing. The spring diaphragm is also bent about a small bending radius at an edge of the valve housing, at which the spring diaphragm is fixed, thereby subjecting the spring diaphragm to a point loading. It is believed that the high loading (stress) may sheer off the spring diaphragm at the edge of the recess.

German Published Patent Application No. 195 19 762 purportedly concerns a fuel injector, in which an actuator space is sealed from a combustion chamber by a ring-shaped elastomer seal that is placed between a valve housing and a valve needle. It is believed that a disadvantage of such a fuel injector is that the elastomer seal is not joined to the valve needle or the valve housing. It is also believed that this can result in the elastomer seal being moved or twisted, which may cause the fuel injector to malfunction.

It is also believed that a disadvantage of elastomer seals, and especially of ring-shaped elastomer seals, is that they cannot completely seal the actuator space from the combustion chamber, particularly at high fuel pressures, because of material permeation or propagation. This may lead to a portion of the fuel penetrating into the actuator space. In addition, the materials of elastomer seals may harden at low temperatures.

SUMMARY OF THE INVENTION

It is believed that the fuel injector according to an exemplary embodiment of the present invention should provide a resistant, hermetic sealing of the actuator. This should protect the actuator from both the pressure of the fuel and the chemical action of the fuel.

It is also believed to be advantageous that the sealing element is bent over at a bending segment to give the sealing element a U-shaped profile. In this manner, it is believed that the fuel-pressure loading of the sealing element is uniformly distributed, which should have a favorable effect on the service life of the fuel injector.

It is also believed to be advantageous that the valve housing and/or the sealing plate has an uncoiling surface, on which a part of the bending segment of the sealing element is uncoiled in response to the fuel injector being actuated. This even allows large valve-needle lifts to be realized.

The sealing member may be advantageously designed as an actuator top (or head), which at least partially encloses the actuator. The actuator acts, via the actuator head, on a valve needle joined to the valve closure member. This provides a compact design to the fuel injector.

In addition, the sealing member may be advantageously joined to a valve needle. This allows the actuating device to transmit a force, via the sealing member, to the valve needle to both open and close the valve.

Another advantage is believed to be provided by making or manufacturing the sealing element from a metallic material. This provides a seal that is resistant to aging, and whose operability is better ensured over a large temperature range.

Furthermore, it is also believed to be advantageous that the sealing element is made or manufactured by "deep-drawing". This should enable the fuel injector to be manufactured cost-effectively.

DETAILED DESCRIPTION

Figure 1:
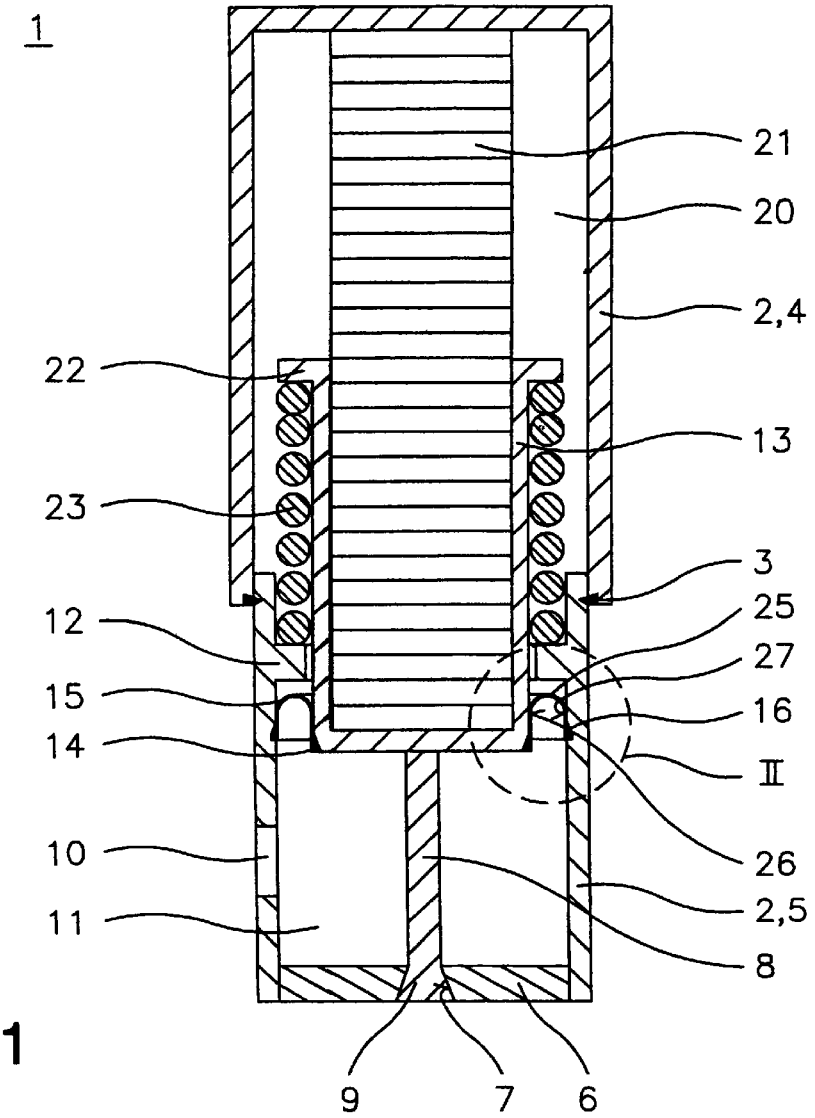
FIG. 1 shows an axial section of a fuel injector according to an exemplary embodiment of the present invention.

FIG. 1 shows a fuel injector 1 of an exemplary embodiment of the present invention in an axial sectional view. Fuel injector 1 may be used as a "direct fuel injector" for injecting fuel, especially gasoline, directly into a combustion chamber of a mixture-compressing, spark ignition engine. However, fuel injector 1 of the exemplary embodiment of the present invention is also suited for other application cases.

Fuel injector 1 has a valve housing 2, which includes two housing sections 4, 5 interconnected by a welded seam 3. Valve housing 2 is joined to a valve-seat member 6, which has a valve seat 7. A valve-closure member 9, which can be actuated by a valve needle 8, interacts with valve seat 8 to form a sealed seat. Valve-closure member 9 may be formed in the shape of a truncated cone, which widens in the direction of injection. In this exemplary embodiment, valve-closure member 9 is designed along with valve needle 8 as one piece. Housing section 5 of valve housing 2 has an opening 10, through which a fuel-intake nipple is laterally guided to valve housing 2 of fuel injector 1. Fuel is introduced through opening 10 into fuel chamber 11 of fuel injector 1.

A circumferential shoulder 12, which extends into the interior of fuel injector 1, is formed in housing section 5 of valve housing 2. Valve needle 8 is joined to a sealing member 13. Sealing member 13 is joined, via a first circumferential welded seam 14, to an elastically deformable and band-shaped sealing element 15, which is joined to valve housing 2 via a second circumferential welded seam 16.

In this exemplary embodiment, sealing member 13 is designed as an actuator head, which encloses a section of actuator 21 that is disposed in an actuator space 20. In this case, actuator 21 may be a piezoelectric actuator or a magnetostrictive actuator, or any other suitably appropriate actuator. Sealing member 13, which is designed as an actuator head, has a flange 22, on which compression spring 23 is supported. The compression spring 23 applies an initial force to actuator 21, and is supported on the other side on shoulder 12 of valve housing 2. In response to being actuated, actuator 21 expands and acts, via sealing member 13 designed as an actuator head, on valve needle 8 joined to valve-closure member 9.

Sealing member 13 and sealing element 15 (the latter of which is joined to sealing member 13 by first circumferential welded seam 14, is elastically deformable and band-shaped, and is joined to valve housing 2 by second circumferential welded seam 16) form a seal that hermetically seals fuel chamber 11 from actuator space 20. Sealing element 15 is bent over at bending segment 25, so that sealing element 15 has a U-shaped profile. Starting out from fuel chamber 11, sealing element 15 is thereby bent back into the direction of combustion chamber 11. Uncoiling surfaces 26, 27 are provided on valve housing 2 and sealing element 13. A part of bending segment 25 of sealing element 15 is uncoiled on the uncoiling surfaces in response to fuel injector 1 being actuated. In this case, sealing element 15 does not have any folded or sharply curved regions, even when fuel injector 1 is actuated, so that stresses in sealing element 15 are distributed at least approximately uniformly in sealing element 15. It is believed that this also enables sealing element 15 to seal actuator space 20 against high fuel pressures in fuel chamber 11. In response to actuator 21 being actuated, and the accompanying movement of sealing member 13 with respect to valve housing 2, at least a part of bending segment 25 of sealing element 15 uncoils on one of uncoiling surfaces 26, 27, so that no additional stresses should occur in sealing element 15.

Actuator 21 expands in response to fuel injector 1 being actuated, whereby valve-closure member 9 is lifted off valve seat 7 of valve seat member 6, and fuel is sprayed out of fuel injector 1.

Figure 2:
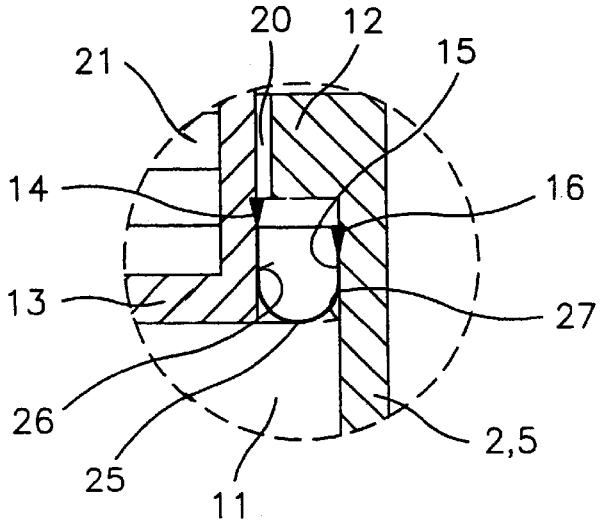
FIG. 2 shows a detail section in an alternative embodiment (the detail being denoted in FIG. 1 by II).

FIG. 2 shows, in an alternative embodiment, an axial sectional view of the detail section denoted by II in FIG. 1. Features or parts that have already been described use the same reference numerals.

In contrast to the exemplary embodiment represented of FIG. 1, sealing element 15 of this exemplary embodiment is bent, starting from actuator space 20, in the direction of fuel chamber 11, and then from here, back into actuator space 20. Once again, sealing element 15 is bent over at bending segment 25, so that sealing element 15 has a U-shaped profile, and welded seams 14, 16 are on the side of actuator space 20. In this manner, a part of bending segment 25 can likewise be uncoiled, in response to actuator 21 being actuated, on uncoiling surface 27 of valve housing 2 and/or on uncoiling surface 26 of sealing member 13. As with the exemplary embodiment of FIG. 1, this should minimize or at least reduce any stresses associated with sealing element 15.

It is also believed to be advantageous to make or manufacture sealing element 15 from a metallic material so that actuator space 20 is hermetically sealed from fuel chamber 11. In addition, it is believed that sealing element 15 may be made or manufactured in a relatively cost-effective manner by "deep-drawing". In both exemplary embodiments, it is believed to be an advantage to bend sealing element 15 into an approximately semicircular shape at bending segment 25. This is because the bending stresses occurring at bending segment 25 of sealing element 15 should then be distributed over bending segment 25 in an approximately uniform manner.

Finally, the fuel injector 1 may be of the type that opens to the inside, or any other suitably appropriate fuel injector for use with the above-described features.

What is claimed is:

1. A fuel injector for a fuel-injection system of an internal combustion engine, the fuel injector comprising:

a valve housing;

a valve seat;

a seal;

an actuator, the actuator being one of a piezoelectric actuator and a magnetostrictive actuator, the actuator being arranged in an actuator space of the valve housing, the actuator space being sealed from a fuel by the seal; and a valve-closure member actuatable by the actuator and interacting with the valve seat to form a sealed seat;

wherein the seal includes a sealing member and a sealing element, the sealing element being joined to the sealing member by a first circumferential welded seam, being elastically deformable and band-shaped, and being joined to the valve housing by a second circumferential welded seam.

2. The fuel injector of claim 1, wherein the sealing element is bent over at a bending segment so that the sealing element has a U-shaped profile.

3. The fuel injector of claim 2, wherein one of the valve housing and the sealing member includes an uncoiling surface, on which a part of the bending segment of the sealing element uncoils in response to the fuel injector being actuated.

4. The fuel injector of claim 1, further comprising a valve needle joined to the valve-closure member, wherein the sealing member includes an actuator top at least partially enclosing the actuator, and the actuator acts via the actuator top on the valve needle.

5. The fuel injector of claim 1, further comprising a valve needle, wherein the sealing member is joined to the valve needle.

6. The fuel injector of claim 1, wherein the sealing element includes a metallic material.

7. The fuel injector of claim 6, wherein the sealing elements is made by a deep-drawing method.

* * * * *